US010689893B2

(12) United States Patent
Selvaag

(10) Patent No.: US 10,689,893 B2
(45) Date of Patent: Jun. 23, 2020

(54) SLIDING DOOR

(71) Applicant: SELVAAG GRUPPEN AS, Oslo (NO)

(72) Inventor: Ole Gunnar Selvaag, Oslo (NO)

(73) Assignee: SELVAAG GRUPPEN AS, Oslo (NO)

( * ) Notice: Subject to any disclaimer, the term of this patent is extended or adjusted under 35 U.S.C. 154(b) by 0 days.

(21) Appl. No.: 15/744,020

(22) PCT Filed: Jul. 22, 2016

(86) PCT No.: PCT/NO2016/050163
§ 371 (c)(1),
(2) Date: Jan. 11, 2018

(87) PCT Pub. No.: WO2017/018888
PCT Pub. Date: Feb. 2, 2017

(65) Prior Publication Data

US 2018/0209192 A1 Jul. 26, 2018

(30) Foreign Application Priority Data

Jul. 24, 2015 (NO) ..... 20150964

(51) Int. Cl.
*E05D 15/06* (2006.01)
*E06B 3/46* (2006.01)

(52) U.S. Cl.
CPC ..... *E05D 15/0656* (2013.01); *E05D 15/06* (2013.01); *E05D 15/0626* (2013.01);
(Continued)

(58) Field of Classification Search
CPC . E05D 15/0656; E05D 15/0626; E05D 15/06; E05D 15/063; E06B 3/4654; E05Y 2900/14
(Continued)

(56) References Cited

U.S. PATENT DOCUMENTS 2,026,886 A * 1/1936 Goeltz ..... E06B 3/4654 49/372
2,271,762 A * 2/1942 Draper ..... B65D 39/082 29/512
(Continued)

FOREIGN PATENT DOCUMENTS

EP 0053300 9/1982
EP 1681428 7/2006
(Continued)

*Primary Examiner* — Gregory J Strimbu
(74) *Attorney, Agent, or Firm* — Bycer Law, PLC; Matthew L. Bycer

(57) ABSTRACT

A sliding door arrangement comprising a sliding door (1) which is movably suspended from a rail system (23, 24) in order to be moved horizontally between two end positions wherein the door respectively opens and closes a door opening (10). The sliding door (11) is mounted in a housing (1) arranged for insertion in a wall (15) in a building. The housing is made of metal plate material and comprises two vertical long walls, two vertical short walls, one top wall, and one bottom wall. The long walls have door openings that at least partly are bordered by sealing elements. The door has a sealing element on its bottom side. The housing with the door installed is manufactured in a factory and shipped to the building site as a unit ready for installation in the wall.

11 Claims, 8 Drawing Sheets

(52) U.S. Cl.
CPC ..... *E06B 3/4654* (2013.01); *E05D 15/063* (2013.01); *E05Y 2800/12* (2013.01); *E05Y 2900/132* (2013.01); *E05Y 2900/14* (2013.01)

(58) Field of Classification Search
USPC ..... 49/495.1, 476.1
See application file for complete search history.

(56) References Cited

U.S. PATENT DOCUMENTS 2,889,585 A * 6/1959 Bon, III ..... E06B 7/22 16/100
3,009,984 A * 11/1961 Lindgren ..... E06B 3/4654 174/369
3,091,004 A * 5/1963 Mays ..... E06B 3/4654 49/372
3,100,916 A 8/1963 McKinney
3,493,032 A * 2/1970 Brown et al. ..... E05D 15/0626 16/87 R
4,370,831 A * 2/1983 Hamilton ..... H05K 9/0015 174/375
6,289,643 B1 * 9/2001 Bonar ..... E06B 3/4654 49/505
2004/0003556 A1 * 1/2004 Zerbst ..... E04B 2/7422 52/220.7
2006/0150545 A1 * 7/2006 Migliorini ..... E06B 3/4654 52/204.1
2015/0219344 A1 * 8/2015 Glover ..... F24D 5/02 165/59

FOREIGN PATENT DOCUMENTS

EP 2 381 056 * 10/2011
EP 2687666 7/2013
FR 2 745 601 * 9/1997
WO WO 0118343 3/2001

* cited by examiner

SLIDING DOOR

CLAIM OF PRIORITY

The present application includes subject matter disclosed in and claims priority to Norwegian Patent Application No. 20150964 (Provisional) filed on Jul. 24, 2015; and Patent Cooperation Treaty (PCT) application Serial No. PCT/NO2016/050163, entitled "A Sliding Door" filed Jul. 22, 2016, describing an invention made by the present inventor, and herein incorporated by reference.

BACKGROUND OF THE INVENTION

(1) Field of the Invention

The present invention relates to sliding doors for a dwelling, and more particularly relates to housing assemblies for contained sliding doors that can be easily installed as a unit.

(2) Description of the Related Art

Sliding doors have the advantage that they are easy to operate for functionally disabled persons and the door function requires less space. Hinged doors swing out into the room and make them difficult to operate for people in wheelchairs. When the door is open, the space behind the door is often useless. The use of sill free sliding doors in dwellings instead of hinged doors has become all the more desirable because new building codes about accessibility and universal designs have become mandatory.

However, sliding doors have the weakness that they provide poor sound installation between rooms and seal poorly against draft and cold air. Furthermore, sliding doors are more complicated to install because the door leaf, rails, casters and floor guides are delivered as separate parts. The door leaf and rails can be mounted on the outside of the wall, the result being that the wall where the door runs cannot be furnished. Alternatively, the door leaf and rails can be mounted inside a double wall, making the wall thicker and more costly and requiring more room than a regular wall. In total, sliding door solutions are relatively expensive, and their use is therefore more limited than desirable. The layout of dwellings could be more compact and area efficient with more extensive use of sliding door solutions.

SUMMARY OF THE INVENTION

The present invention alleviates these deficiencies by allowing the sliding door to be delivered to the building site fully installed and adjusted in an enclosing housing solution. This solution permits the complete sliding door element to be mounted directly into an ordinary wall portion, without requiring the installer to have the technical abilities for mounting together the sliding door parts. Thus, the assembly work is shifted from the building site to controlled conditions in a factory.

A solution having a steel housing around the sliding door may be mounted on the building site, for later completion with surface finishing like plaster boards or the like.

Another solution, which is not part of the invention, may be based more on wooden materials, where the sliding door element is delivered with a housing of fiber board, for example MDF-plates. In this case the element is almost a finished wall portion which is integrated into the adjacent walls.

From the factory, the sliding doors may also be provided with an electrically driven motor for simpler operation (plug-in solution).

The sliding door is made sound insulating by placing dense sound-proofing means in the periphery of the door. Such means may be dense brushes having elastic bristle which extend practically sound-proof between the door leaf, walls and floor. Alternatively, a felt having elastic extending fibers can be used. It may also be envisioned to use elastic weather stripping permitting the door to move without troublesome friction, or a combination of brush and weather stripping. In order to prevent that the door leaf, slides directly against the wall material on the opposite side of the sealing means, a soft material may be installed, for instance felt, which provides the door with a smooth and "frictionless" movement.

BRIEF DESCRIPTION OF THE DRAWINGS

For further understanding of the invention, it will be described more closely with reference to the appended drawings, where.

DETAILED DESCRIPTION OF THE INVENTION

Figure 1:
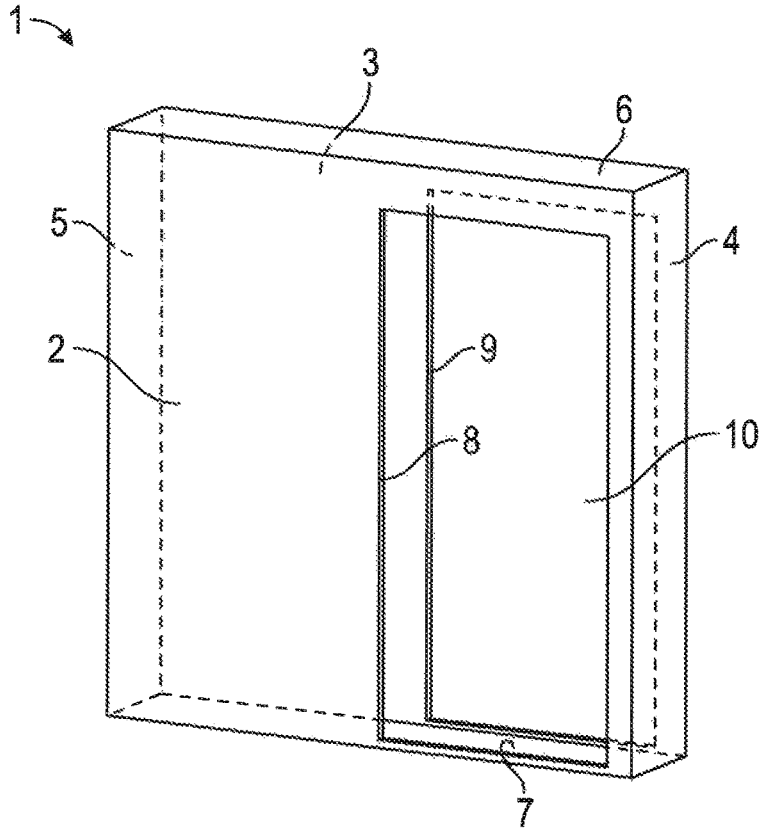
FIG. 1 is a perspective view of a sliding door housing according to the invention.

FIG. 1 schematically shows a sliding door housing 1 according to the invention. The housing is tall and narrow with substantially parallel-epipedic form. It has two vertical long walls 2 and 3, two narrow vertical short walls 4 and 5, a top wall 6 and a bottom wall 7. The long walls 2, 3 are provided with opposite openings 8 and 9 in order to form a door opening 10.

Figure 2:
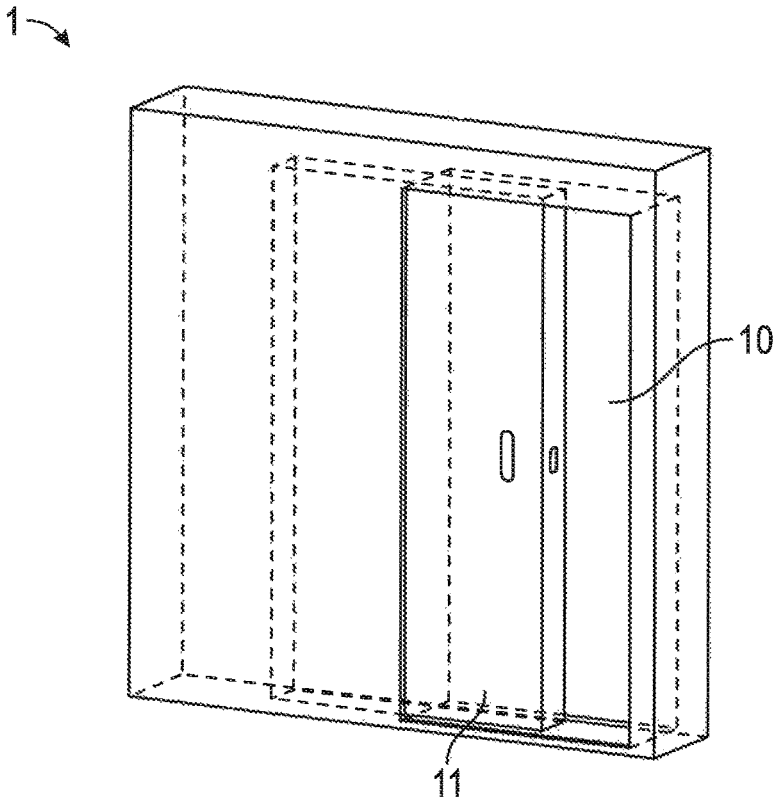
FIG. 2 is a view similar to FIG. 1 and shows additionally an installed sliding door in semi-open position.

FIG. 2 shows the sliding door housing 1 in FIG. 1 with an installed sliding door 11 in semi-open position.

Figure 3:
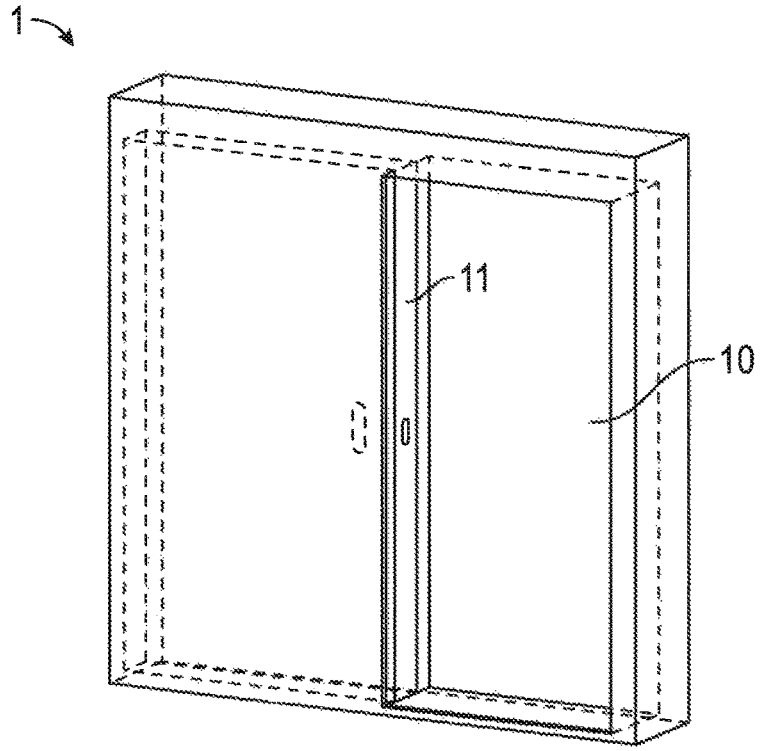
FIG. 3 shows a view similar to FIG. 2, but with the sliding door in open position.

FIG. 3 shows like FIG. 2 the housing 1 with a sliding door 11 installed, but with the door in open position.

Figure 4:
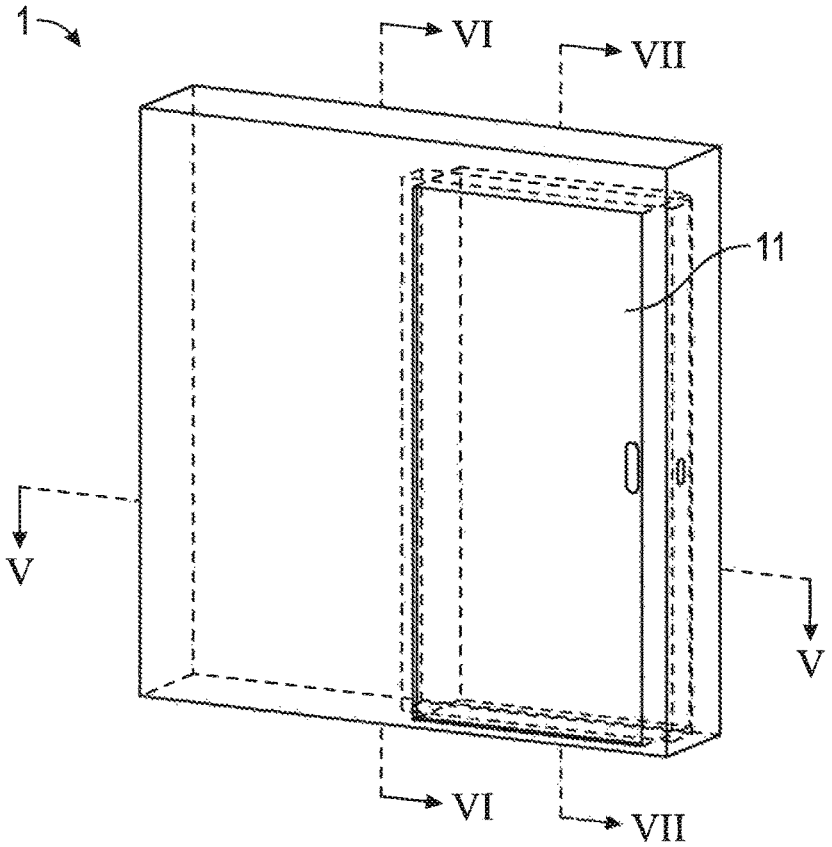
FIG. 4 shows a view similar to FIG. 2, but with the sliding door in closed position.

FIG. 4 shows the housing of FIG. 3 with the door completely closed.

Figure 5:
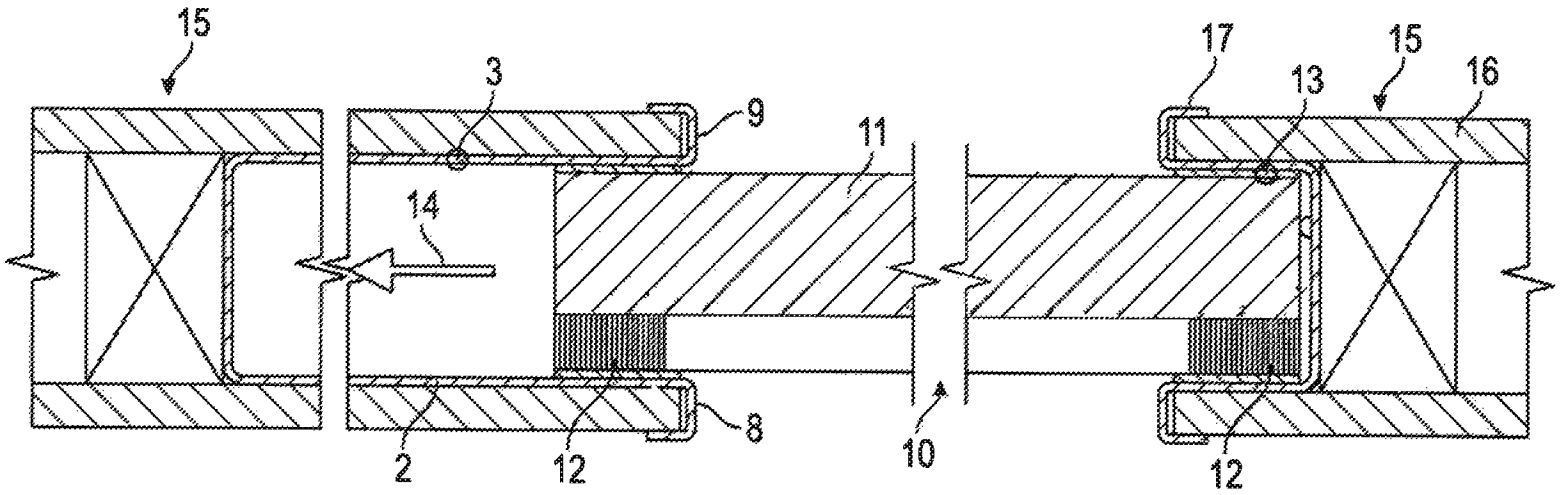
FIG. 5 shows a longitudinal section along the line V-V in FIG. 4.

FIG. 5 shows a horizontal section through the sliding door housing as indicated in FIG. 4. This section shows the long walls 2 and 3 of the housing, which may be manufactured from 1 mm thick galvanized steel plate. Along the vertical edges of the opening 8 there is arranged sealing brushes 12 which will seal against the door 11 in its closed position. Along the vertical edges of the opening 9 there is arranged a soft felt 13 in order to facilitate a soft and frictionless movement of the door 11. The arrow 14 suggests the direction of movement of the door when it is opened.

FIG. 5 also shows that the sliding door housing is built into a wall structure 15, where plates 16 are inserted in folded edges 17 of the openings 8, 9.

Figure 6:
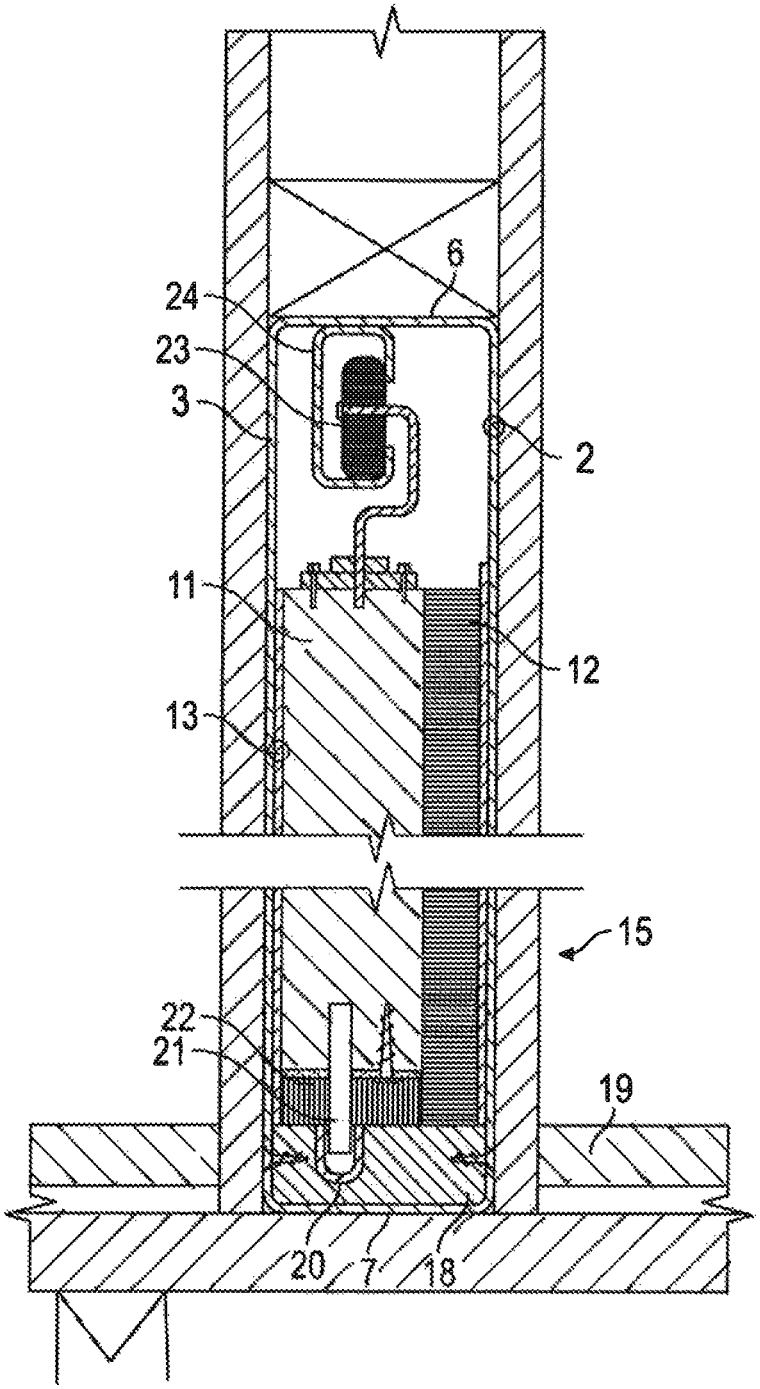
FIG. 6 shows a vertical section along the line VI-VI in FIG. 4.

FIG. 6 shows a section along the line VI-VI in FIG. 4. Again, the sealing brush 12 and the felt 13 are seen. Additionally, a sill 18 in the bottom 7 of the housing is shown. The top of the sill 18 is flush with the adjacent floor 19, in order to permit unhindered movement of wheelchairs through the door opening. A U-formed groove 20 in the sill provides guiding for a suitable guiding means 21 attached to the lower edge of the door. The lower edge is also provided with a sealing brush 22. At the top the door is provided with a caster support 23, which runs in a rail which is firmly fixed in the top wall 6 of the housing.

Figure 7:
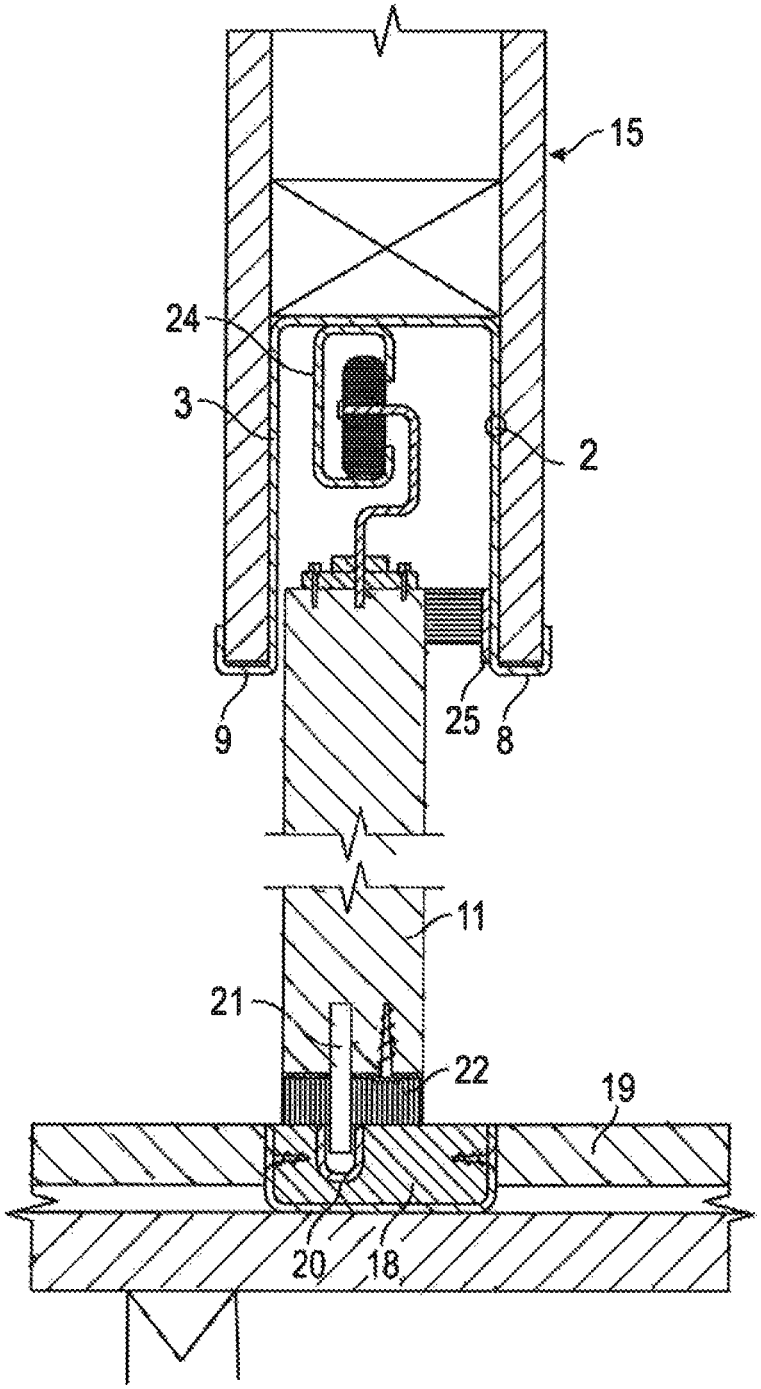
FIG. 7 shows a vertical section along the line VII-VII in FIG. 4.

FIG. 7 is a section along the line VII-VII in FIG. 4, i.e. through the door opening 10. This section shows a sealing brush 25 being arranged along the upper edge of the opening 8. The sealing brush 12 along the longitudinal edges and the sealing brush 22 on the underside of the door together will form a continuous sound-proofing along the entire circumference of the door.

Figure 8:
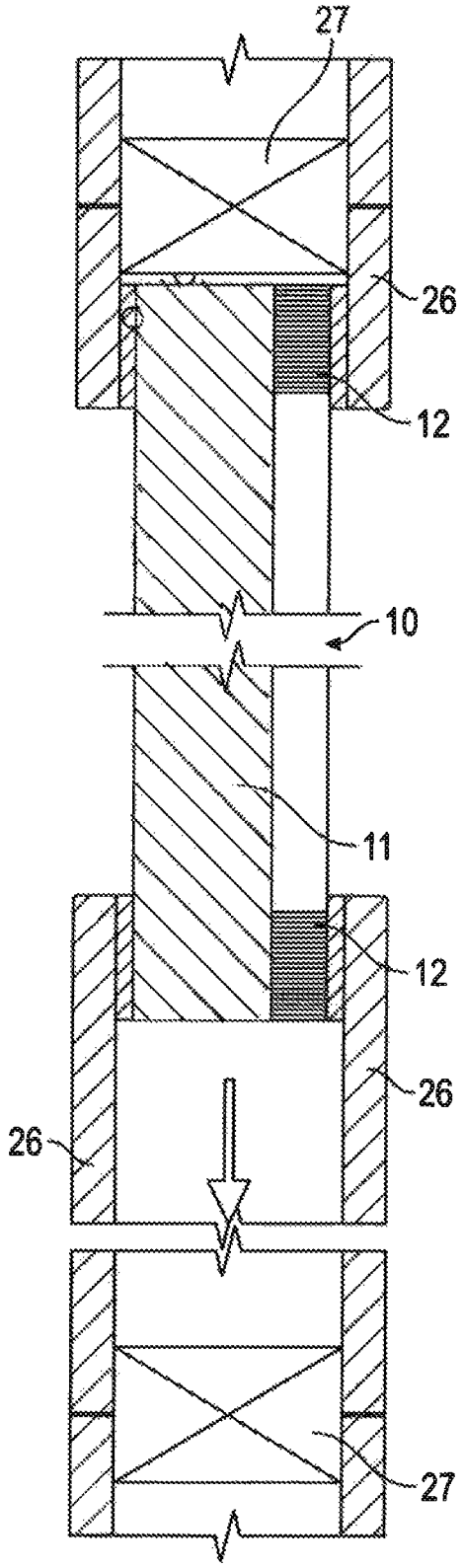
FIG. 8 shows a section similar to FIG. 5 through a second exemplifying embodiment of a sliding door housing.

FIG. 8 shows a section similar to FIG. 5, with the difference that the housing of steel plate is replaced by a housing of ordinary building materials, i.e. building plates 26, e.g. fiber plates such as MDF-plates, or plywood, and a framework 27 of woodwork. Thus, the housing may form a finished wall portion to be integrated into the adjacent walls.

Figure 9:
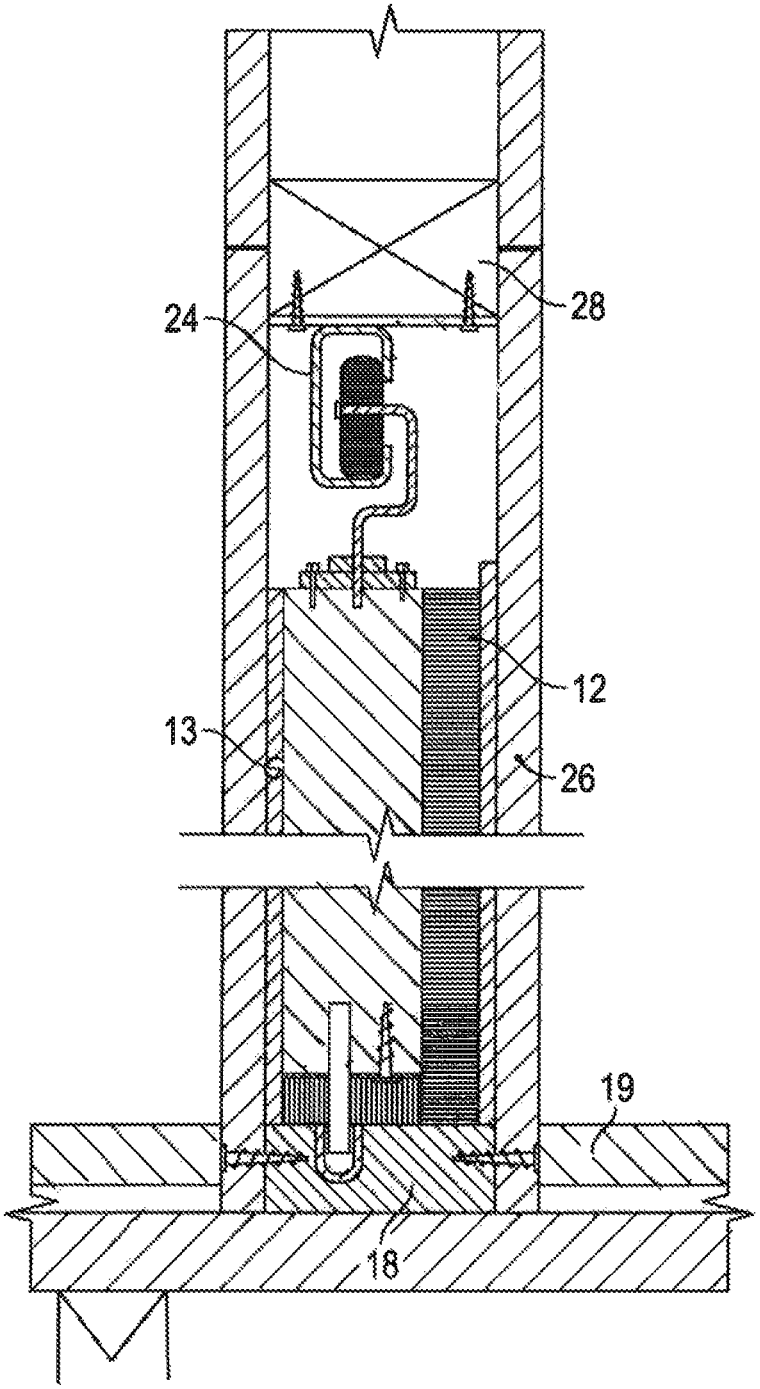
FIG. 9 is a section similar to FIG. 6 of this second exemplifying embodiment.

FIG. 9 shows a section similar to FIG. 6 through the housing, and FIG. 8. The rail 24 for suspending the sliding door is attached to a top piece 28 of woodwork corresponding to the top wall 6 of the housing.

Figure 10:
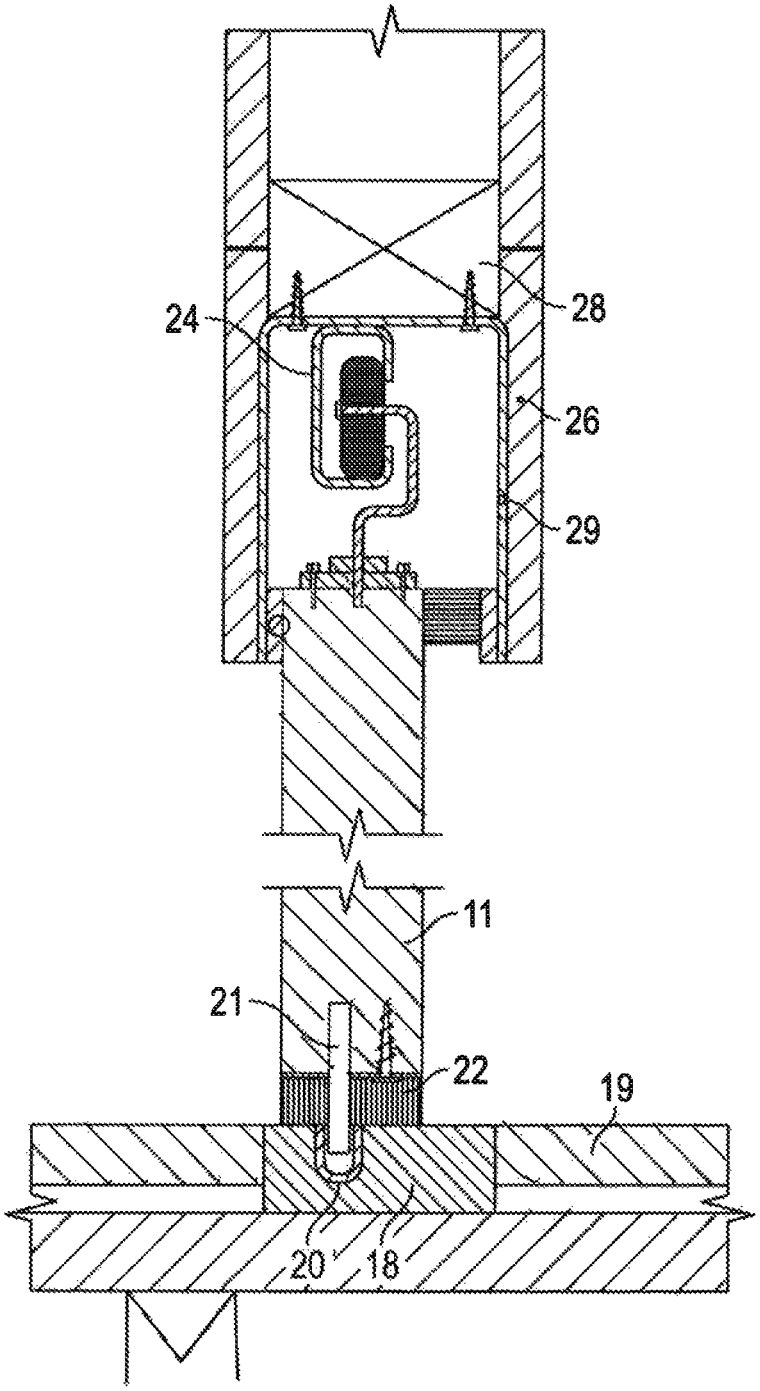
FIG. 10 is a section similar to FIG. 7 through a third exemplifying embodiment

FIG. 10 is a section similar to FIG. 7 of the embodiment according to FIGS. 8 and 9, with the difference that the rail 24 is attached to an inverted U-formed reinforcement 29, e.g. of steel plate material, in order to provide a stiffened support for the rail 24. This is of importance in order to secure that the finally adjusted, straight extent of the rail from the factory is not disturbed when the housing is mounted in the wall structure.

It will be understood that the invention is not limited to the exemplifying embodiments shown in the drawings, but that it may be modified and varied by the skilled person within the scope of the following claims.

The invention claimed is:

1. A sliding door arrangement, comprising:

a housing for insertion in a wall of a building, wherein the housing is made of sheet metal and comprises two vertical long walls, two vertical short walls, one top wall, and one bottom wall;

wherein the two vertical long walls, the two vertical short walls, the top wall, and the bottom wall form a one-piece, unitary, integral structure;

wherein said two vertical long walls have wall openings which form a door opening through the housing;

wherein said top wall includes a rail system attached thereto;

a sliding door is movably suspended from said rail system in order to be moved horizontally between an open end position and a closed end position in which said sliding door respectively opens and closes said door opening;

wherein the housing, along a vertical edge and an upper edge of at least one of the wall openings, is provided with sealing elements which seal against the sliding door as the door moves to said closed end position;

wherein the housing includes grooves for receiving a part of the building wall therein;

wherein the sliding door comprises a bottom side, said bottom side being provided with a sealing element which seals against the bottom wall of the housing; and wherein said sealing elements are selected from the group consisting of sealing brushes, felt, and felt with elastic extending fibers.

2. A sliding door arrangement according to claim 1, wherein said bottom side of the sliding door is provided with guiding elements which cooperate with a groove.

3. A sliding door arrangement according to claim 1, wherein the grooves are provided along vertical edges of the wall openings which includes the vertical edge of the at least one of the wall openings.

4. A sliding door arrangement according to claim 1, wherein the sheet metal comprises galvanized steel plate about 1 mm thick.

5. A sliding door arrangement according to claim 1, further comprising casters which run in a rail of the rail system and from which the sliding door is suspended.

6. A sliding door arrangement according to claim 5, wherein said bottom side of the sliding door is provided with guiding elements which cooperate with a groove.

7. A sliding door arrangement according to claim 5, wherein the sheet metal comprises galvanized steel plate about 1 mm thick.

8. A sliding door arrangement, comprising:

a housing for insertion in a wall of a building, wherein the housing is made of sheet metal and comprises two vertical long walls, two vertical short walls, one top wall, and one bottom wall;

wherein the two vertical long walls, the two vertical short walls, the top wall, and the bottom wall form a one-piece, unitary, integral structure;

wherein said two vertical long walls have wall openings which form a door opening through the housing;

wherein said top wall includes a rail system attached thereto;

a sliding door is movably suspended from said rail system in order to be moved horizontally between an open end position and a closed end position in which said sliding door respectively opens and closes said door opening;

wherein the housing, along a vertical edge and an upper edge of at least one of the wall openings, is provided with sealing elements which seal against the sliding door as the door moves to said closed end position;

wherein the housing includes grooves for receiving a part of the building wall therein;

wherein the housing further comprises a threshold disposed between the bottom wall of the housing and the sliding door at least when the sliding door is in the closed end position, the threshold comprising a top side arranged to be flush with an adjacent floor; and wherein the sliding door comprises a bottom side provided with a sealing element which seals against the threshold of the housing.

9. A sliding door arrangement according to claim 8, wherein said bottom side of the sliding door is provided with guiding elements which cooperate with a groove in the threshold of the housing.

10. A sliding door arrangement according to claim 8, wherein the sheet metal comprises galvanized steel plate about 1 mm thick.

11. A sliding door arrangement according to claim 8, wherein the grooves are provided along vertical edges of the wall openings which includes the vertical edge of the at least one of the wall openings.

* * * * *